US010220609B2

(12) United States Patent
Anderson et al.

(10) Patent No.: US 10,220,609 B2
(45) **Date of Patent: *Mar. 5, 2019**

(54) IMPEDANCE MEASUREMENTS AT TIME INSTANTS

(71) Applicant: HEWLETT-PACKARD DEVELOPMENT COMPANY, L.P., Houston, TX (US)

(72) Inventors: Daryl E. Anderson, Corvallis, OR (US); Eric T. Martin, Corvallis, OR (US); Peter James Fricke, Corvalllis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/684,465

(22) Filed: Aug. 23, 2017

(65) Prior Publication Data

US 2017/0348968 A1 Dec. 7, 2017

Related U.S. Application Data

(63) Continuation of application No. 15/306,737, filed as application No. PCT/US2014/036247 on Apr. 30, 2014, now Pat. No. 9,776,395.

(51) Int. Cl.

| | |
|---|---|
| ***B41J 2/045*** | (2006.01) |
| ***B41J 2/165*** | (2006.01) |
| ***B41J 2/175*** | (2006.01) |

(52) U.S. Cl.
CPC ..... *B41J 2/0451* (2013.01); *B41J 2/0458* (2013.01); *B41J 2/04541* (2013.01);
(Continued)

(58) Field of Classification Search
CPC ..... B41J 2/175; B41J 2/0451; B41J 2/04541; B41J 2/04555; B41J 2/0458;
(Continued)

(56) References Cited

U.S. PATENT DOCUMENTS

| | | | |
|---|---|---|---|
| 4,498,088 | A | 2/1985 | Kanayama |
| 5,072,235 | A | 12/1991 | Slowik et al. |

(Continued)

FOREIGN PATENT DOCUMENTS

| | | |
|---|---|---|
| CN | 101362400 | 2/2009 |
| JP | 1999334102 | 12/1999 |

(Continued)

OTHER PUBLICATIONS

Korean Intellectual Property Office, International Search Report and Written Opinion for Appl. No. PCT/US2014/036247 dated Feb. 2, 2015 (11 pages).

(Continued)

*Primary Examiner* — Anh T. N. Vo
(74) *Attorney, Agent, or Firm* — HP Inc.—Patent Department

(57) ABSTRACT

In an example, a print head comprises a nozzle to be activated by a delayed fire pulse that is delayed from an initial fire pulse, a sensor to measure an impedance of the nozzle, and a detector to determine a first time instant following the delayed fire pulse for registering a first impedance measurement by the sensor.

20 Claims, 9 Drawing Sheets

(52) U.S. Cl.
CPC ..... *B41J 2/04555* (2013.01); *B41J 2/04573* (2013.01); *B41J 2/04588* (2013.01); *B41J 2/04598* (2013.01); *B41J 2/165* (2013.01); *B41J 2/16579* (2013.01); *B41J 2/175* (2013.01)

(58) Field of Classification Search
CPC ..... B41J 2/04573; B41J 2/04588; B41J 2/04598; B41J 2/165; B41J 2/16579; B41J 2/14153; B41J 2002/14354
See application file for complete search history.

(56) References Cited

U.S. PATENT DOCUMENTS

| | | | | |
|---|---|---|---|---|
| 5,500,657 | A | 3/1996 | Yauchi et al. | |
| 6,109,732 | A | 8/2000 | Wen | |
| 6,257,694 | B1 | 7/2001 | Tokumaru et al. | |
| 6,290,333 | B1 | 9/2001 | Wade | |
| 6,398,332 | B1 | 6/2002 | Silverbrook et al. | |
| 6,435,668 | B1 | 8/2002 | Barbour et al. | |
| 6,729,707 | B2 | 5/2004 | Corrigan | |
| 7,029,082 | B2 | 4/2006 | Farr et al. | |
| 7,110,139 | B2 | 9/2006 | Silverbrook | |
| 7,259,588 | B2 | 8/2007 | Ahne | |
| 8,870,322 | B2 * | 10/2014 | Martin | B41J 2/0451 347/14 |
| 9,776,395 | B2 * | 10/2017 | Anderson | B41J 2/175 |
| 9,931,837 | B2 * | 4/2018 | Anderson | B41J 2/0451 |
| 2002/0021315 | A1 | 2/2002 | Sato et al. | |
| 2002/0063745 | A1 | 5/2002 | Osborne | |
| 2009/0040258 | A1 | 2/2009 | Baek | |
| 2010/0033539 | A1 | 2/2010 | Silverbrook et al. | |
| 2011/0084997 | A1 | 4/2011 | Chen et al. | |
| 2013/0278656 | A1 * | 10/2013 | Govyadinov | B41J 2/2142 347/9 |
| 2013/0278657 | A1 | 10/2013 | Martin et al. | |

FOREIGN PATENT DOCUMENTS

| | | |
|---|---|---|
| WO | WO-9632263 | 10/1996 |
| WO | WO-2013062517 | 5/2013 |
| WO | WO-201358099 | 10/2013 |
| WO | WO-2013158105 | 10/2013 |

OTHER PUBLICATIONS

Wijshoff et al.; Manipulating Drop Formation in Piezo Acoustic Inkjet; Océ-Technologies B.V., Venlo, the Netherlands; Mar. 14, 2007 (4 pages).

* cited by examiner

IMPEDANCE MEASUREMENTS AT TIME INSTANTS

CROSS REFERENCE TO RELATED APPLICATIONS

This is a continuation of U.S. application Ser. No. 15/306,737, having a national entry date of Oct. 25, 2016, which is a national stage application under 35 U.S.C. § 371 of PCT/US2014/036247, filed Apr. 30, 2014, which are both hereby incorporated by reference in their entirety.

BACKGROUND

Inkjet printing involves the release or ejection of printing fluid drops such as ink drops onto a print medium, such as paper. The ink drops bond with the paper to produce visual representations of text, images or other graphical content on the paper. In order to accurately produce the details of the printed content, nozzles in a print head accurately and selectively release multiple ink drops as the relative positioning between the print head and printing medium is precisely controlled. Over a period of time and use, the nozzles of the print head may develop defects and therefore cease to operate in a desired manner. As a result, print quality may be adversely affected.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1A:
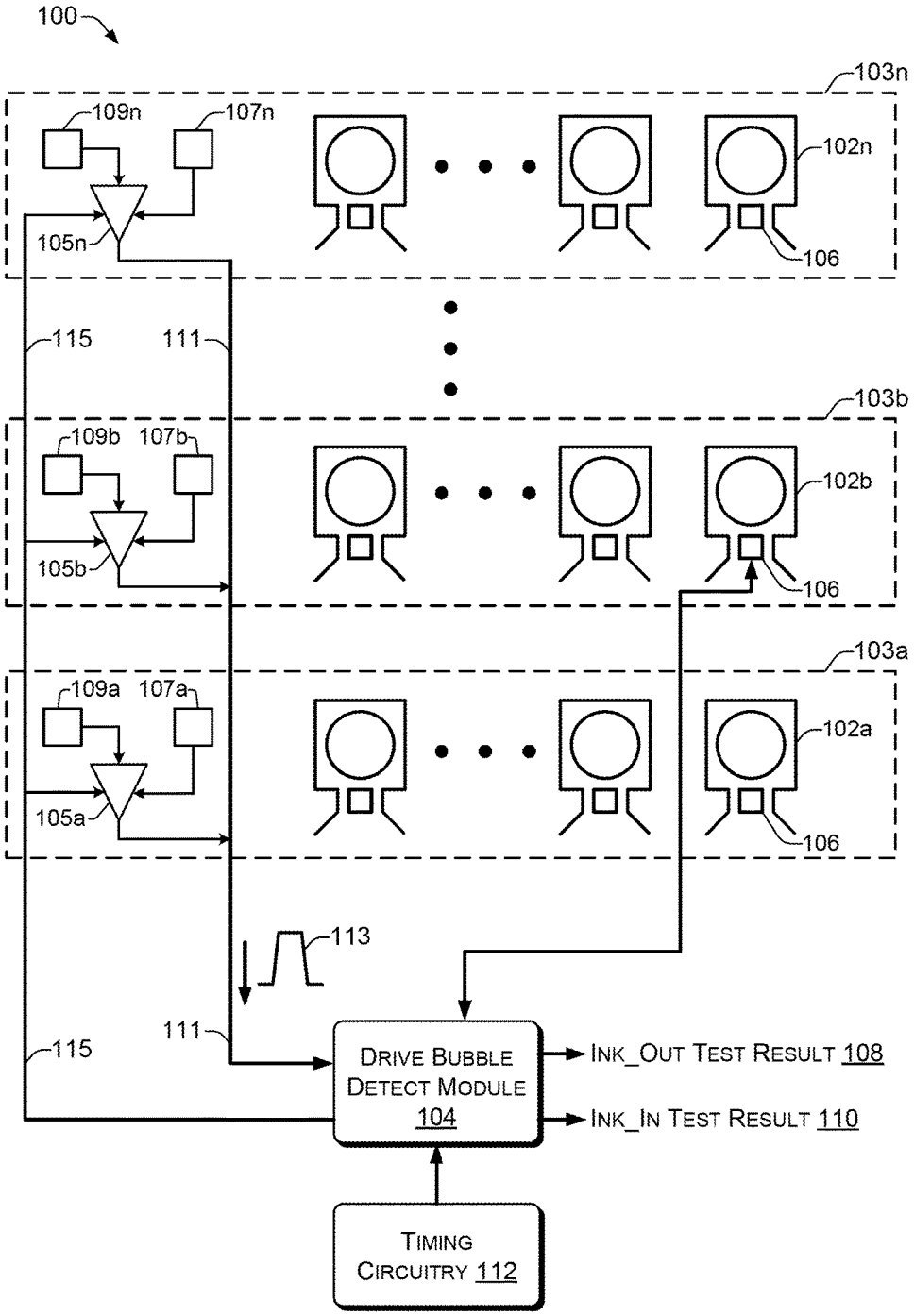
FIG. 1*a* shows an example system for determining print head nozzle conditions based on drive bubble detect measurements whose timing is relative to an actual nozzle firing time indicated by a delayed fire pulse.

Systems and methods for determining print head nozzle conditions of an inkjet printing system are described. Modern inkjet printing systems or printers print content on a print medium, such as paper. The printing is implemented by directing multiple drops of printing fluid such as ink onto the print medium. The ink is directed through multiple nozzles positioned on a print head of the printing system as the print head and print medium move relative to each other. For example, the print head may move laterally with the print medium being conveyed through a conveying mechanism. Depending on the image content to be printed, the printing system determines the exact time instance and position at which the ink drops are to be released/ejected onto the print medium. In this way, the print head releases multiple ink drops over a predefined area to produce a representation of the image content to be printed. Besides paper, other forms of print media may also be used.

The print head releases/ejects ink drops through an array of nozzles provided on the print head. The ink ejected through each nozzle comes from a corresponding ink chamber in fluid communication with the nozzle. The ink chamber is in fluid communication with an ink supply through ink delivery pathways within the print head that enable ink ejected from the chamber to be replenished. Each ink chamber holds the ink and periodically releases a predetermined amount to a corresponding nozzle for printing.

When the print head is not printing, the ink is retained in the ink chamber by capillary forces and/or back-pressure acting on the ink within the nozzle passage. Each ink chamber includes a heating element to generate heat within the chamber which causes small volumes of ink to expand and vaporize. The vaporization of the ink results in the formation of a bubble within the ink chamber. The bubble, also referred to as a drive bubble, may further expand to drive or eject an ink drop onto the print medium. As an ink drop is ejected, the bubble collapses and the volume of the dispensed ink drop is subsequently replenished within the chamber from an ink supply through ink delivery pathways within the print head.

Ink nozzles are subjected to many such cycles of heating, drive bubble formation and collapse, and ink volume replenishments from an ink supply. Over a period of time, and depending on other operating conditions, ink nozzles within the print head may become blocked or otherwise defective. Nozzle blockages can occur due to a variety of factors such as particulate matter within the ink that can cause the ink nozzle to get clogged. In some cases, small volumes of ink may solidify over the course of the printer's operation resulting in the clogging of the print nozzle. As a result, the formation and release of the ink drop may be adversely affected. Since the ink drop has to form and be released at precise instances of time, any such blockages in the print nozzle are likely to have an impact on the print quality. Accordingly, in order to ensure that print quality is maintained, the condition of the print nozzle, i.e., whether it is blocked or whether it is experiencing other issues such as a deprimed chamber, is determined.

In order to help maintain nozzles in a healthy condition, appropriate measures such as nozzle servicing and nozzle replacement can be performed at various times, such as in advance of printing. The condition of a print nozzle can be monitored and determined through logical circuitry that can include a sensor on the print nozzle. The sensor can be used for detecting the presence or absence of a drive bubble. For example, an ink volume present within the print nozzle ink chamber will offer less electrical impedance to a current provided by the sensor than will a drive bubble present within the print nozzle ink chamber. When a drive bubble is present, air within the drive bubble offers a high resistance as compared to the resistance offered by the ink volume.

Depending on the impedance measurements and corresponding voltage variations due to the ink within the ink chamber, a determination can be made regarding whether or not a drive bubble has formed. Determining whether or not a drive bubble has formed can provide an indication about whether the print nozzle is operating in a desired manner. Furthermore, through the nozzle sensor, it may also be determined whether or not a drive bubble has formed at any specific instance or instances of time. For example, a blockage in the print nozzle will affect the formation of the drive bubble at a specific instance of time. If a drive bubble has not formed as expected at a particular instance of time, it can be determined that the nozzle is blocked and/or not working in the intended manner. Similarly, such a sensor-based mechanism can also determine whether or not a drive bubble has collapsed at a specific instance of time. Upon collapse of the drive bubble, the ink has usually been replenished, and this condition can be detected by the nozzle sensor. If it is determined that the drive bubble has not collapsed at a predetermined or expected instance of time, it can further be determined that the nozzle has become defective in some manner.

The print head may incorporate circuitry that assists in implementing the functionality of the print head. The sensor based mechanisms as described above, may operate based on signals generated by the sensors. Such signals can be communicated off the print head circuitry, or off-chip, or off the print head die. The signals can be communicated to a processing unit of the printer for processing so as to determine the condition of the print nozzle. However, communicating such signals off-chip to the processing unit or to other components of the printer consumes bandwidth and can introduce timing issues that might affect the accuracy of such determinations. The processing of the sensor signals may also be done on-chip (i.e., on the print head die), but such an implementation involves complex circuitry that uses excessive die space and increases cost.

Accordingly, example systems and methods have been previously developed that implement minimal circuitry on-chip (i.e., on the print head die) to evaluate print head nozzle conditions by detecting the presence and absence of drive bubbles within nozzle ink chambers. Determinations about nozzle conditions are performed on-chip, which reduces the demand on bandwidth for communicating condition-related information to different components of the printer, and reduces computation overhead on the printer processing unit. The minimal circuitry can be implemented using a plurality of logic-based components that reduce system complexity.

An example system includes a sensor within a print nozzle. The sensor can be an impedance sensor to determine variations in impedance of a sensed medium that changes between ink and air within the nozzle ink chamber as drive bubbles form and collapse. The impedance depends on the current passing through the sensed medium, and it can be compared to a threshold to determine nozzle conditions. The nozzle chamber includes a heating element, and during a printing operation the heating element causes the print nozzle to release or fire/eject ink drops onto a print medium to print desired image content. The release of an ink drop can be based on a signal, referred to as a firing pulse, received from a print processor. A fire pulse provides an indication to the print nozzle to fire or release an ink drop onto the print medium, and it results in energy being applied to the heating element to effectuate the firing of the ink drop. Energy from a fire pulse activates the heating element to generate heat, which causes a drive bubble to form within the ink chamber. As the drive bubble expands, it forces an ink drop out of the chamber and through the ink nozzle. Once the ink drop is ejected, the drive bubble collapses and the volume of ink ejected is replenished within the chamber by an ink supply reservoir in preparation for subsequent firing.

As the drive bubble forms and collapses within the chamber, variations in impedance can occur, and the different impedance values can be measured through the sensor positioned within the print nozzle. The varying values of impedance can be measured at specific instances of time following the end of the firing pulse (i.e., either the rising edge or the falling edge of the firing pulse). For example, impedance values can be measured at a first predetermined time instant and at a second predetermined time instant following the end of the firing pulse. The impedance values can be compared with predefined threshold values to determine whether or not the print nozzle is functioning properly or in a healthy condition.

For example, the first predetermined time instant may correspond to a time after the end of the firing pulse at which a drive bubble is expected to have formed. If the impedance measured at such a first predetermined time instant is high, in correspondence with a predefined threshold, it may be concluded that the drive bubble has formed in an appropriate manner. However, if impedance variations occur at the first predetermined time instant (e.g., the measured impedance value increases from low to high with respect to a threshold), it may be concluded that the print nozzle is blocked. Similarly, if the measured impedance at the first predetermined time instant varies from high to low, it may be concluded that the drive bubble formed is a weak drive bubble. In addition, if the impedance measured at such a first predetermined time instant is low, which is not in correspondence with a predefined threshold, it may be concluded that no drive bubble has formed and that there may be an issue with the heating element.

After an ink drop is ejected from the print nozzle, the drive bubble collapses and the volume of ink expended by the print nozzle is replenished within the ink chamber through an ink supply reservoir. As a result, the sensor is brought back into contact with ink by a second predetermined time instant following the end of the fire pulse (e.g., the falling edge of the firing pulse). Thus, at the second predetermined time instant, a measured impedance should have changed from a high value (i.e., before drive bubble collapse) to a low value (i.e., after drive bubble collapse). If the measured impedance at the second predetermined time instant is at a low value that corresponds with a predefined threshold, it may be concluded that the print nozzle is functioning properly. However, if the measured impedance at the second predetermined time instant is not a low value that corresponds with a predefined threshold, it may be concluded that the print nozzle is not functioning properly. In such a case, the print nozzle may be blocked or it may have a stray bubble present.

Measured impedance values and impedance variations associated with the print nozzle can be converted to one or more logical output signals, for example, in the form of a binary output. The logical output signals are obtained by processing the signals associated with the impedance variations through minimal logical circuitry provided on the print head. The logical output signals are subsequently registered or latched onto the components of the minimal circuitry. The minimal circuitry implemented on the print head die can register the logical output signals at the first predefined time interval and the second predefined time interval. Based on the logical output signals, the condition of the print nozzle can be evaluated. The logical output signals can be a series of 0's and 1's that indicate whether the condition of the print nozzle is healthy or not.

Thus, the logical output itself indicates the condition of the print nozzle. For example, the logical output signals represented as a combination of 0's and 1's, can be mapped to different indicative conditions of the print nozzle. Depending on what the logical output is, the condition of the print nozzle is evaluated based on the mapping. Accordingly, further processing of the logical output signals is unnecessary, and the logical output signals need not be communicated off the print head die, say, to a processor of the printer, to determine the print nozzle condition. In this manner, use of resources to communicate and process signals indicating print nozzle conditions may be avoided. Furthermore, since the circuitry for determining the condition of the print nozzle is implemented using a plurality of logical-based components, the resulting circuitry is less complex.

As noted above, impedance values can be measured within an ink chamber of a print nozzle to determine the presence and absence of drive bubbles at a first predetermined time instant and at a second predetermined time instant following the end of a firing pulse (e.g., the falling edge of the firing pulse), and the impedance values can be compared with predefined threshold values to determine whether or not the print nozzle is functioning properly or in a healthy condition. However, there can be timing issues related to when the fire pulse actually occurs that make it difficult to identify, for example, a first predetermined time instant after the end of the fire pulse when a drive bubble is expected, and a second predetermined time instant after the end of the fire pulse when a drive bubble is expected to have collapsed.

Such timing issues are due at least in part, to the manner in which print nozzles are arranged on a print head. Print nozzles are typically arranged in nozzle columns and grouped together within primitives designed to receive firing pulses that are delayed with respect to an initial firing pulse issued from a controller. The primitives are arranged in a series along each nozzle column, and an initial fire pulse is delayed by a delay element within each primitive as the fire pulse propagates up the column from one primitive to the next. The delayed fire pulse is an intentional design feature that facilitates power management on the print head by spreading out the timing of switching nozzles on and off to reduce the magnitude of current change. However, because the timing of the delayed fire pulse is different at each primitive, there is a challenge in knowing the actual time when a specific nozzle's fire pulse occurs. If the actual time of a nozzle's fire pulse is unknown, it is not possible to know, for example, a first predetermined time instant after the end of the fire pulse when a drive bubble is expected. Likewise, if the actual time of a nozzle's fire pulse is unknown, it is not possible to know a second predetermined time instant after the end of the fire pulse when a drive bubble is expected to have collapsed.

Example systems and methods disclosed herein compensate for the varying fire pulse delays that each nozzle (primitive) sees, and thereby enable communication of the actual, local (and delayed) firing pulses that occur at each primitive to a drive bubble detect (DBD) circuit. The DBD circuit can then use the delayed fire pulse from a primitive to initiate a DBD measurement of a particular nozzle within that primitive at a particular instant in time relative to the actual firing time of the nozzle. More specifically, for each primitive within a nozzle column, a system takes advantage of an existing data latch and an added tri-state device to drive back to a DBD circuit, the local, actual, delayed fire pulse that occurs at the primitive (i.e., at the nozzle in that primitive). This enables the DBD circuit to initiate a DBD measurement of a nozzle under test within that primitive at a predetermined instant of time that is relative to the actual firing time of the nozzle indicated by the delayed fire pulse, rather than a firing time that would be indicated by the initial, non-delayed fire pulse. The tri-state device of a primitive is enabled when both a "1" is present in the primitive's data latch and a DBD-enable line of the buffer is high. The DBD-enable line is a wire that runs the length of the column through each primitive. The tri-state device drives the delayed fire pulse of the primitive onto a single, compensated fire pulse return bus, which is also a wire that runs the length of the column through each primitive and connects to the DBD circuit.

The above methods and systems are further described with reference to FIGS. 1 to 7. It should be noted that the description and figures merely illustrate the principles of the present subject matter. It is thus to be understood that various arrangements may be devised that, although not explicitly described or shown herein, embody the principles of the present subject matter. Moreover, all statements herein reciting principles, aspects, and examples of the present subject matter, are intended to encompass equivalents thereof.

FIG. 1*a* illustrates an example system 100 for determining print head nozzle conditions based on drive bubble detect (DBD) measurements whose timing is relative to an actual nozzle firing time indicated by a local, delayed fire pulse. The system 100 as described is implemented within circuitry of a print head of a printer. The system 100 includes a plurality of print nozzles 102 (illustrated in part as nozzles 102*a*-102*n*) arranged in columns (not shown), with one print nozzle under test (e.g., nozzle 102*b*) coupled to a DBD circuit module 104. The nozzles 102 are grouped together in primitives 103 (illustrated as primitives 103*a*-103*n*). Each primitive 103 includes a tri-state buffer device 105 (illustrated respectively as 105*a*-105*n*), a data latch 107 (illustrated respectively as 107*a*-107*n*), and a delay latch 109 (illustrated respectively as 109*a*-109*n*). A compensated fire pulse bus 111 runs through each primitive 103 along the length of a column to carry a delayed fire pulse 113 to the DBD circuit module 104 from a primitive (e.g., primitive 103*b*) that contains the print nozzle under test 102*b*. A DBD enable bus 115 also runs through each primitive 103 along the length of a column to carry an enable signal to tri-state devices 105. Each print nozzle 102 includes a sensor 106 provided within the print nozzle 102 (i.e., within an ink chamber of the print nozzle 102). The sensor 106 may be, for example, an impedance sensor or a voltage sensor. As will be explained subsequently, the sensor 106 measures impedance values and/or variations in impedance values at specific instants of time associated with the formation and collapse of a drive bubble. Based on the measured impedances, the drive bubble detect module 104 provides output test results as logical signals, namely an ink_out test result 108, and an ink_in test result 110. In one example, the sensor 106 measures a voltage across the print nozzle. The impedance or the voltage is measured by passing a current through the medium present within the print nozzle (i.e., a medium of ink, air from a drive bubble, or combination thereof). Since ink is a conducting medium, it provides a lower impedance to current than a drive bubble. Once a drive bubble is formed, the impedance offered through the medium (i.e., air) is high. Consequently, the voltage across the print nozzle would be low and high, respectively.

A printing process may be initiated through an initial firing pulse. Upon receiving the initial firing pulse, a heating element (not shown) within a print nozzle 102 starts heating the ink, thereby resulting in the formation of a drive bubble. Prior to formation of the drive bubble, the ink in contact with the sensor 106 will provide a low impedance. When the drive bubble forms, the ink ceases to be in contact with the sensor 106 and the impedance measured increases to a high value.

The DBD circuit module 104 determines the impedance at one or multiple time instants that are predetermined relative to the end (i.e., trailing edge) of a delayed fire pulse 113 that has been communicated from the primitive 103*b* containing the print nozzle under test 102*b*. The timing of the impedance measurements is managed and controlled by timing circuitry 112. The time instants are determined after a predefined time has elapsed from the occurrence of the delayed firing pulse 113. In one example, the DBD circuit module 104 measures the impedance at time instants prescribed by a first predetermined time instant and second predetermined time instant.

While measuring the impedance associated with the print nozzle, the DBD circuit module 104 may compare the measured impedance with respect to a threshold impedance at the first predetermined time instant. In one example, the timing circuitry 112 may activate the DBD circuit module 104 so that the measured impedance is captured or registered at the occurrence of the first predefined time instant. The DBD circuit module 104 may include one or more latches for registering and providing the outcome. For registering, the measured impedance is stored in the latches.

For a properly functioning print nozzle, a drive bubble will have formed by the first predetermined time instant. Consequently, the measured impedance associated with the print nozzle 102 should be high. Thus, if the DBD circuit module 104 determines that the impedance variation from low (no drive bubble) to high (drive bubble formed) has not occurred by the first predetermined time instant, it may be concluded that the drive bubble either did not form properly or was weak (e.g., collapsed prematurely). On the other hand, if the DBD circuit module 104 determines that the impedance measured is high, and no variations in the measured impedance occur with respect to a threshold impedance, the print nozzle will be considered as healthy and functioning properly. The determination of the DBD module 104 may be represented as a test result. Since the present test result should correspond to a state where the ink is out of the ink chamber of the print nozzle 102, the test result may be referred to as an ink_out test result 108.

The drive bubble detect module 104 may also compare the impedance measured at the second predetermined time instant to the threshold impedance. In one example, the timing circuitry 112 may activate the DBD circuit module 104 so that the measured impedance is captured or registered at the occurrence of the second predefined time instant. The DBD circuit module 104 may include a second set of latches for registering and providing the outcome.

For a properly functioning print nozzle, a drive bubble will have collapsed after the second predetermined time instant. Consequently, the impedance measured would vary from high (drive bubble present) to low (ink present after drive bubble collapse), as the ink is replenished within the ink chamber. Thus, if the DBD circuit module 104 determines that the impedance variation (i.e., high to low) has occurred by the second predetermined time instant, it may be concluded that the drive bubble collapsed, and that the ink supply within the print nozzle was replenished in a timely manner. However, if the DBD module 104 determines that the variation occurs beyond the second predetermined time instant, it may be concluded that the print nozzle 102 is either blocked or that a stray drive bubble is present within the print nozzle 102. In either case, because the present test result should correspond to a state where the ink is in the ink chamber of the print nozzle 102, the test result provided by the DBD module 104 may be referred to as an ink_in test result 110.

In order to evaluate the condition or health of a print nozzle 102, both the ink_out test result 108 and the ink_in test result 110 are used. For example, when both the ink_out test result 108 and the ink_in test result 110 indicate that the drive bubble formed and collapsed in a timely manner, the print nozzle 102 is considered to be healthy. In one example, the ink_out test result 108 and the ink_in test result 110 may be communicated to a processing unit of a printer (not shown) for further implementation of one or multiple remedial actions in response to the ink_out test result 108 and the ink_in test result 110. The ink_out test result 108 and the ink_in test result 110, in one example, may be in a binary form.

Figure 1B:
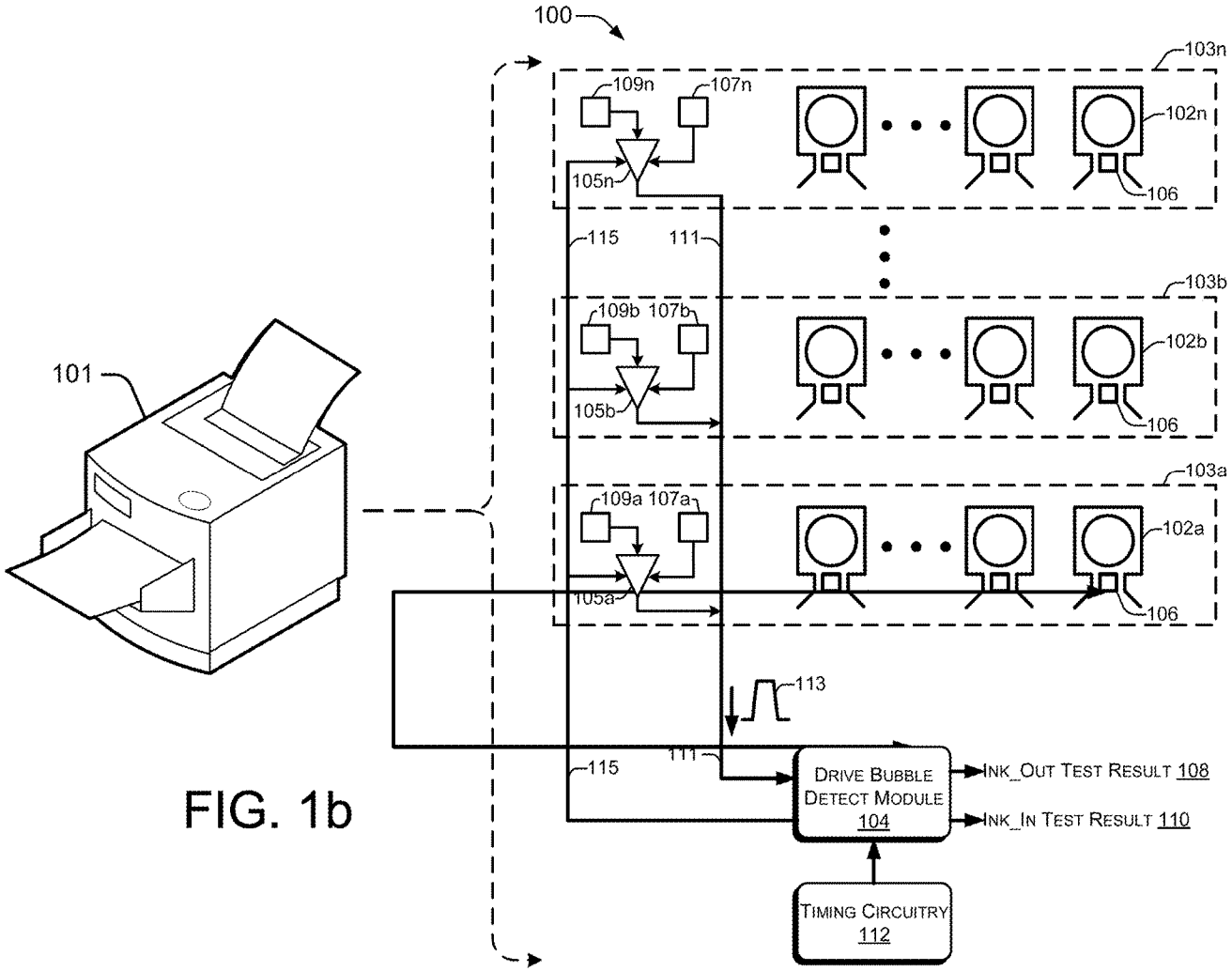
FIG. 1*b* shows an example printer implementing an example system for determining print head nozzle conditions based on drive bubble detect measurements whose timing is relative to an actual nozzle firing time indicated by a delayed fire pulse.

FIG. 1*b* illustrates an example printer 101 implementing an example system for determining print head nozzle conditions based on drive bubble detect (DBD) measurements whose timing is relative to an actual nozzle firing time indicated by a local, delayed fire pulse. As illustrated, the system for evaluating the condition of a print head nozzle, such as the system 100, is implemented within the printer 101. In another example, the drive bubble detect circuit module 104 is implemented onto the print head of the printer 101.

Figure 1C:
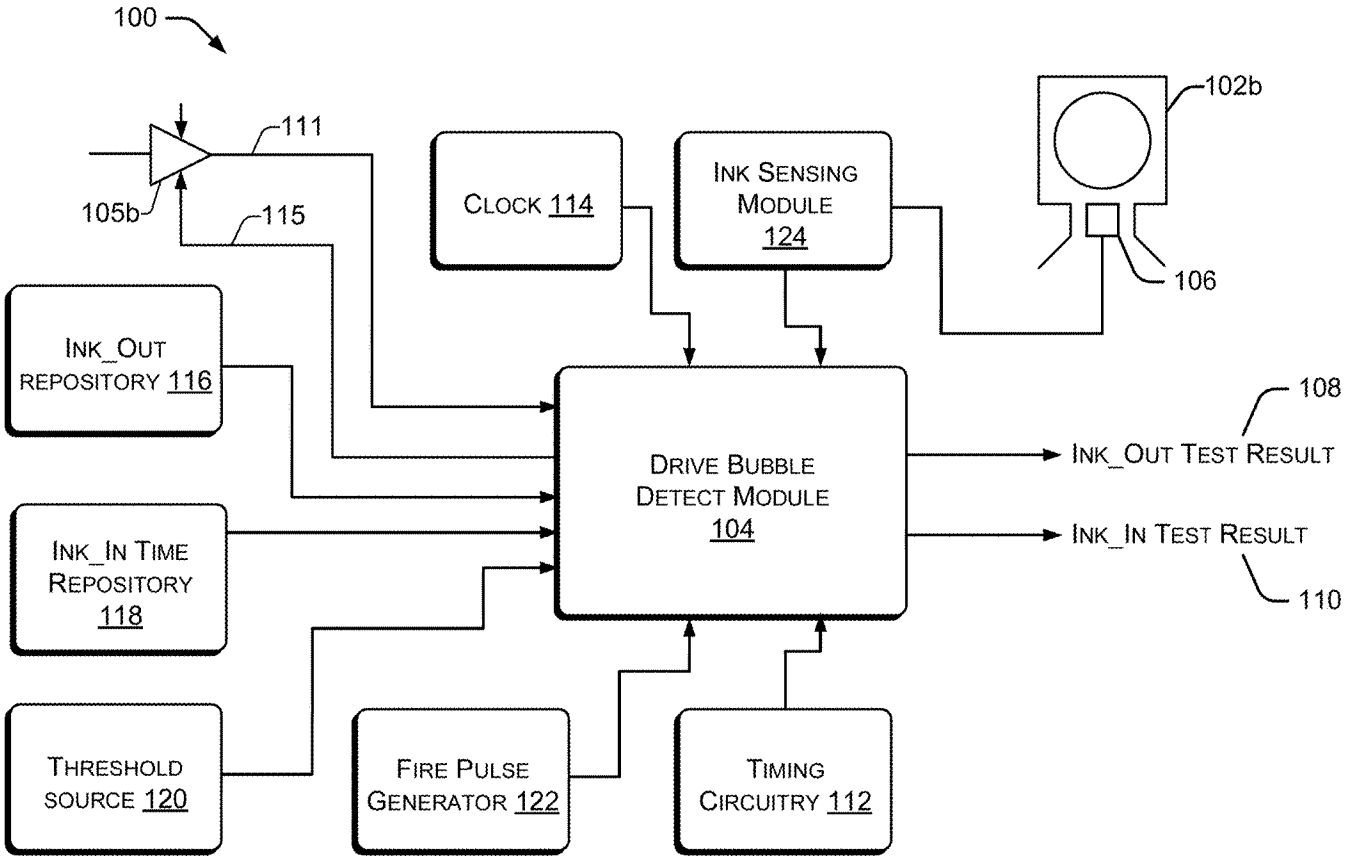
FIG. 1*c* shows an example system for determining print head nozzle conditions based on drive bubble detect measurements whose timing is relative to an actual nozzle firing time indicated by a delayed fire pulse.

FIG. 1*c* illustrates an example system 100 for determining print head nozzle conditions based on drive bubble detect (DBD) measurements whose timing is relative to an actual nozzle firing time indicated by a local, delayed fire pulse. The system 100 as described is implemented within circuitry of a print head of a printer, such as the printer 101. The system 100 includes a print nozzle 102*b* coupled to a DBD circuit module 104. The print nozzle 102*b* further includes a sensor 106 provided within the print nozzle 102*b*. In one example, the sensor 106 is a capacitive sensor and is configured to measure either impedance or voltage associated with the print nozzle. The system 100 further includes a tri-state buffer device 105*b*, a compensated fire pulse bus 111, a DBD enable bus 115, the timing circuitry 112, a clock 114, ink_out time repository 116, ink_in time repository 118, threshold source 120, a firing pulse generator 122, and an ink sensing module 124. Each of the above mentioned modules or components is coupled to a DBD circuit module 104. Although not explicitly represented, each of the modules may be further connected to each other, without deviating from the scope of the present subject matter. The DBD circuit module 104 provides ink_out test result 108 and ink_in test result 110 based on the input received from one or more of the modules as illustrated.

Figure 2:
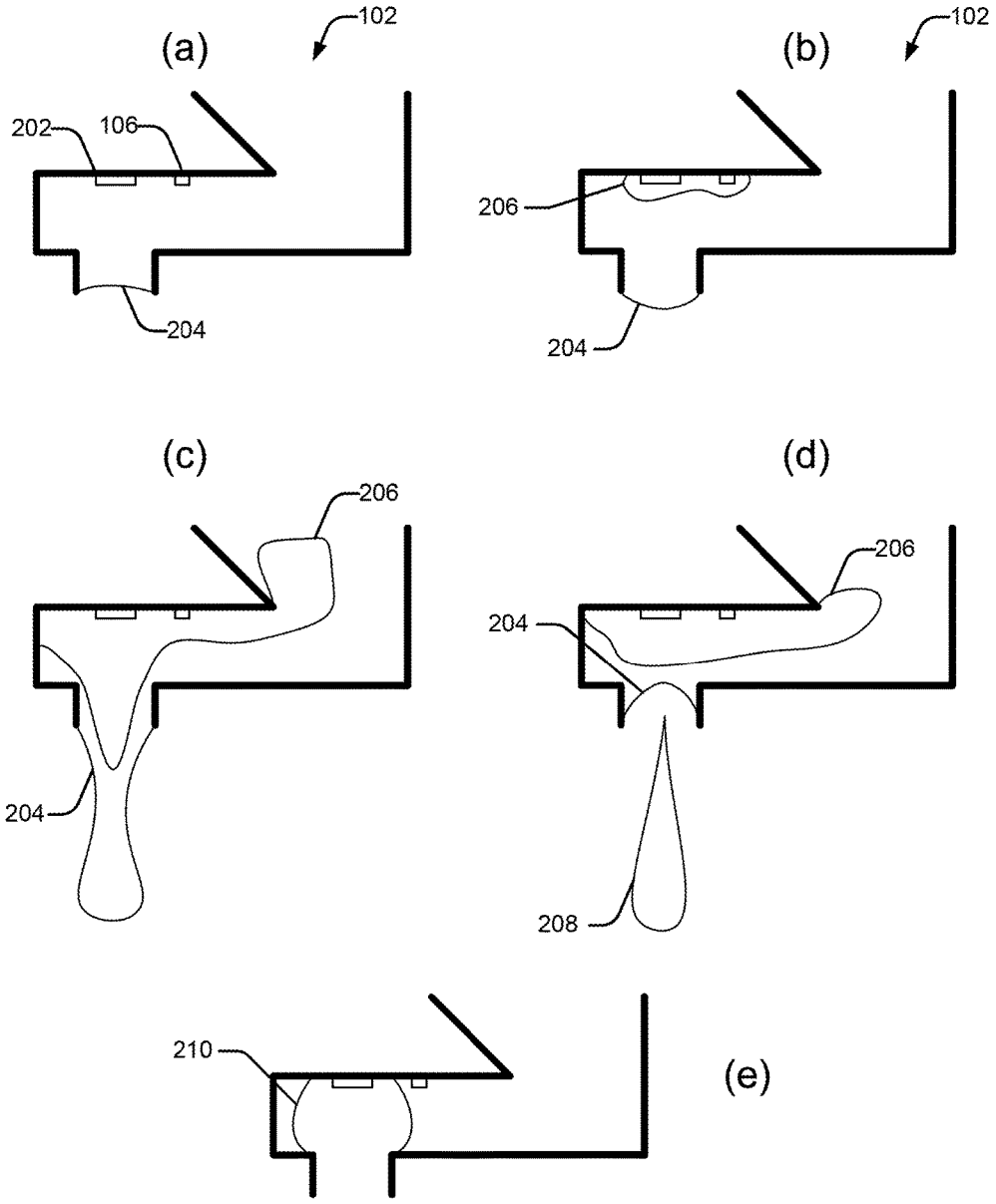
FIG. 2 shows an example print nozzle depicting the formation and the collapse of a drive bubble.

The working of the system 100 can be explained in conjunction with FIG. 2. FIG. 2 provides an illustration of an example print nozzle 102 depicting the formation and the collapse of a drive bubble. In the example shown in FIG. 2, the print nozzle 102 includes a heating element 202 and a sensor 106. Through the action of the heating element 202, the sensor 106 may monitor and measure the variations in the impedance associated with the print nozzle 102 due to the formation of the drive bubble 206.

Continuing with the present example, the print nozzle 102 prepares for ejecting an ink drop based on an initial fire pulse generated by the firing pulse generator 122. The initial fire pulse is delayed prior to arriving at the print nozzle 102 as discussed in more detail below, and it is therefore a delayed fire pulse 113 when it is received at the nozzle. Prior to the nozzle receiving the delayed fire pulse, the ink is retained within the print nozzle 102 due to capillary action, with the ink level 204 contained within the print nozzle 102. Upon receiving the delayed fire pulse, the heating element 202 initiates heating of the ink in the print nozzle 102. As the temperature of the ink in the proximity of the heating element 202 increases, the ink may vaporize and form a drive bubble 206. As the heating continues, the drive bubble 206 expands and forces the ink level 204 to extend beyond the print nozzle 102 (as depicted in FIGS. 2(*a*)-(*c*)).

As noted previously, the ink within the print nozzle 102 will offer a certain electrical impedance to a specific electrical current. Typically, mediums such as ink are good conductors of electric current. Consequently, the electrical impedance offered by the ink within the print nozzle 102 will be low relative to an impedance offered by air within the drive bubble 206. As the print nozzle 102 prepares for ejecting an ink drop, the sensor 106 may pass a finite electrical current through the ink within the print nozzle 102. The electrical impedance or the voltage associated with the print nozzle 102 may be measured through the sensor 106. The following description is presented by way of example, with respect to a measured voltage across the print nozzle 102.

In one example, as the drive bubble 206 forms due to the action of the heating element 202, the ink in the proximity of the sensor 106 may lose contact with the sensor 106. As the drive bubble 206 forms, the sensor 106 may get completely surrounded by the drive bubble 206. At this stage, since the sensor 106 is not in contact with the ink, the impedance, and therefore the voltage measured by the sensor 106, will be correspondingly high. The voltage measured by the sensor 106 will register a constant value during the time interval the sensor 106 is not in contact with the ink. As the drive bubble 206 expands further, the physical forces arising out of the capillary action will no longer be able to hold the ink level 204. An ink drop 208 is formed which then separates from the print nozzle 102. The separated ink drop 208 is thus ejected toward the print medium as shown in FIG. 2(*d*). Once the ink drop 208 is ejected, ink in the print nozzle 102 is replenished by the incoming ink flow from a reservoir. At this stage the heating element 202 also ceases to heat the ink within the print nozzle 102. As the ink is replenished, the drive bubble 206 collapses, resulting in an empty space 210. The remaining space in the proximity of the sensor 106 is thereby restored with ink, which again comes in contact with the sensor 106, as is depicted in FIG. 2(*e*).

The sensor 106 measures the variations in the voltage that occur during the course of drive bubble 206 formation and collapse. The voltage across the print nozzle 102 will remain low at instants when ink is present and the drive bubble 206 is not present, and will be high when the drive bubble 206 is present. While the drive bubble 206 is forming and when the drive bubble 206 has collapsed, the voltage measured by the ink sensing module 124 will vary. In some examples, the variations in voltage across the print nozzle 102 are measured by the ink sensing module 124 at specific time instants. The specific time instants are measured after a predefined time has elapsed following the end (e.g., the falling edge) of the delayed fire pulse 113 which drove the formation of the drive bubble 206. The specific time instants may be representative of the time instants at which the ink would be present and not present within the print nozzle 102 ink chamber.

Figure 3:
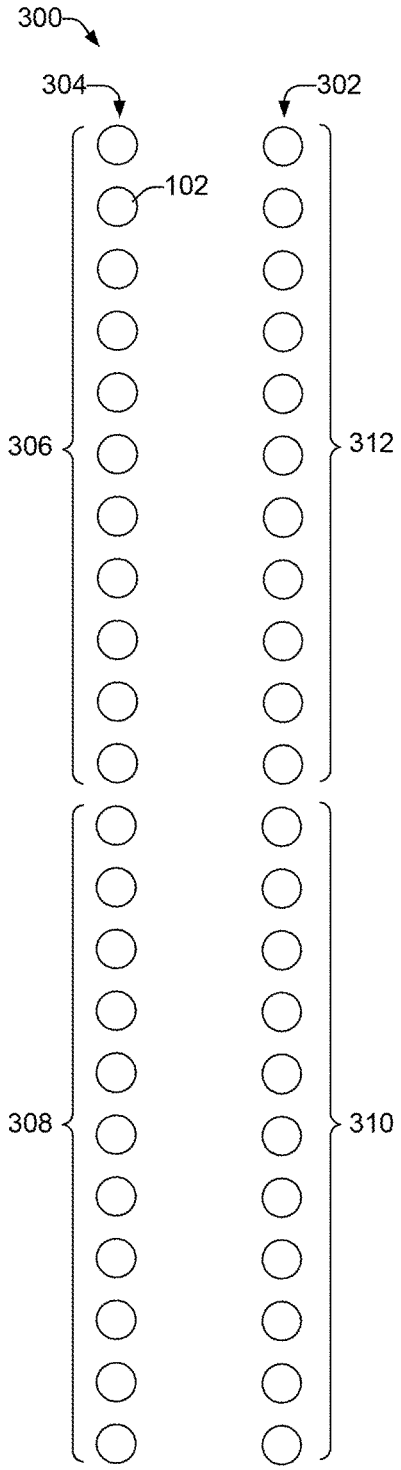
FIG. 3 shows example primitives arranged in a series along nozzle columns.

As noted above, an initial fire pulse from a fire pulse generator 122 is delayed prior to reaching a print nozzle 102. This delay is based at least in part on the way print nozzles can be arranged on a print head, and the manner in which the fire pulse propagates to them. Print nozzles are typically arranged in nozzle columns and grouped together within primitives designed to receive firing pulses that are delayed with respect to an initial firing pulse issued from a controller. FIG. 3 is a diagram of an example arrangement 300 of print nozzles 102 disposed on an underside of a print head. In this example, the nozzles 102 are arranged in two columns 302 and 304. In other examples, the print head can have any number of desired columns of nozzles. Each of the nozzles may have a heating element 202 or some other drive bubble formation mechanism, and a sensor 106. Both the heating element 202 and the sensor 106 may be activated with similar circuitry. The nozzles 102 in each column 302 and 304 may be grouped into primitives 306, 308, 310, and 312. In some examples, just one nozzle 102 within a primitive (306, 308, 310, 312) is activated at a time. In the example of FIG. 3, each primitive has eleven nozzles. However, in other examples, a primitive may have any amount of desired nozzles. The grouping of nozzles into primitives may simplify circuitry for firing nozzles and taking DBD measurements.

As shown in FIG. 3, primitives (306, 308, 310, 312) are arranged in a series along each nozzle column 302 and 304. In general, a particular nozzle is addressable and can be activated/fired by being connected to a row conductor and a primitive conductor (not shown). The primitive conductor is common to all of the nozzles in the primitive, while the row conductor can be multiplexed to the particular nozzle address. Therefore, when a particular nozzle is to be fired, the correct nozzle can be located by applying a voltage to the appropriate row conductor and then applying a fire pulse to the appropriate primitive conductor. However, the fire pulse has been delayed from an initial fire pulse generated by a fire pulse generator 122. That is, the local fire pulse that reaches the primitive such as primitive 306, and causes a nozzle within that primitive to fire, is delayed prior to reaching the primitive 306. The fire pulse is then delayed again for each subsequent primitive as it propagates down or up a column from one primitive to the next.

Figure 4:
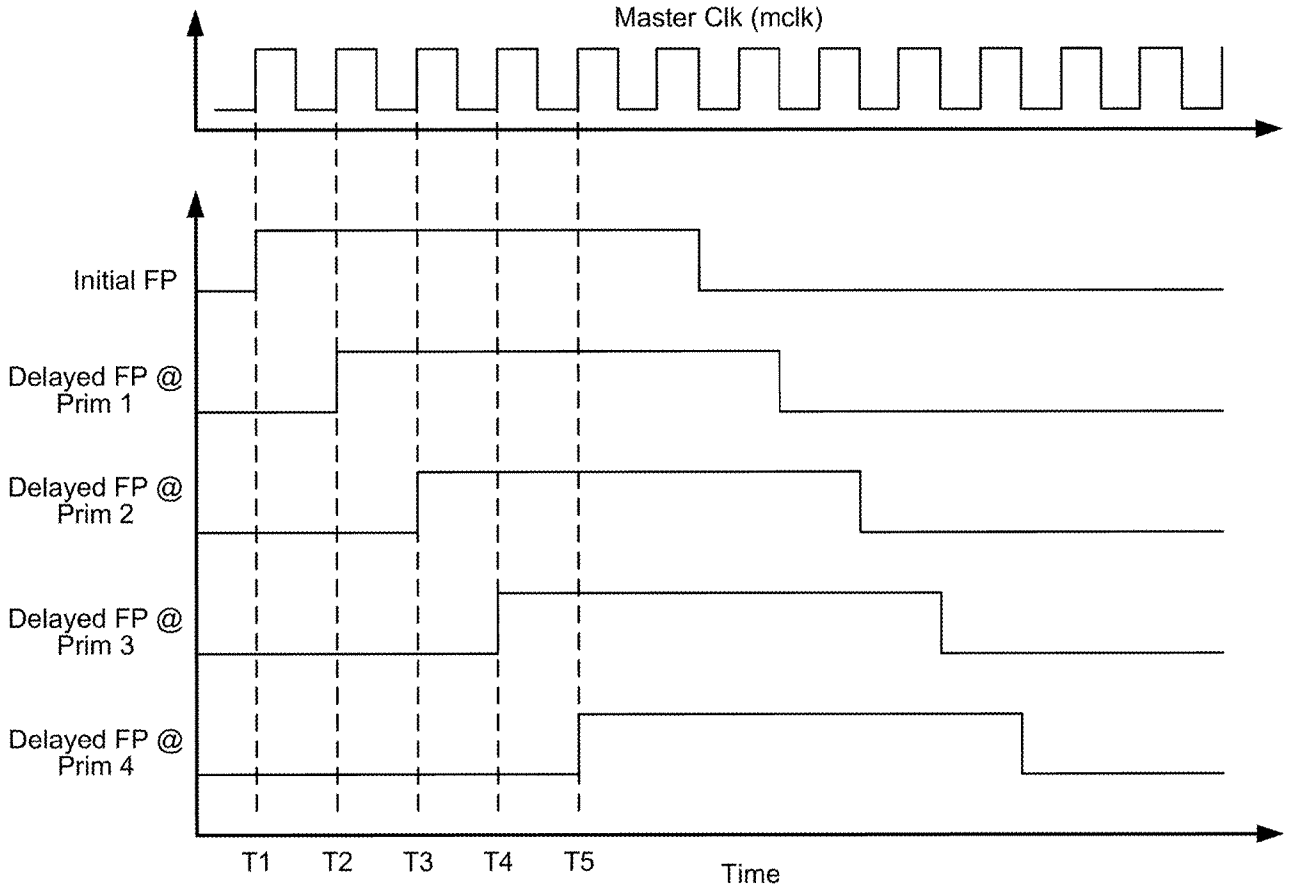
FIG. 4 shows an example of timing waveforms for an initial fire pulse as it is delayed while propagating through a series of four example primitives.

FIG. 4 shows an example of the timing waveforms 400 for an initial fire pulse as it is delayed while propagating through a series of four example primitives (Prim 1, Prim 2, Prim 3, and Prim 4). An initial fire pulse (FP) is provided by a fire pulse generator 122, for example, at time T1. The initial fire pulse is delayed before reaching Prim 1 at a time T2. The delayed fire pulse at Prim 1 is then delayed again by a latch mechanism of Prim 1 prior to reaching the next primitive Prim 2. The delayed fire pulse is delayed in this manner for each of the subsequent primitives Prim 3 and Prim 4. Because the initial fire pulse is delayed in this way, it cannot be used as a timing basis for initiating a DBD measurement through a DBD circuit module 104. Instead, the delayed fire pulse that is local to each primitive, and which actually initiates the drive bubble, should be used as the basis for timing DBD measurements. Using the delayed fire pulse that is local to the primitive (as opposed to the initial fire pulse) as the timing basis for initiating DBD measurements on a nozzle under test within the primitive, enables the DBD measurement module 104 to know the actual time when a nozzle fires. This further enables the DBD module 104 to set one or multiple predetermined time instants after the end of the fire pulse for making DBD measurements. For example, a first predetermined time instant can be set after the end of the fire pulse when a drive bubble is expected, and a second predetermined time instant can be set after the end of the fire pulse when a drive bubble is expected to have collapsed.

Thus, in some examples the specific time instants can include a first predetermined time instant and a second predetermined time instant. The first predetermined time instant may correspond to a point in time when the drive bubble 206 has formed, i.e., when the ink has been or is in the process of being dispensed from the print nozzle 102. The first predetermined time instant can be referred to as an ink_out time. Furthermore, as the drive bubble 206 expands and the ink drop is dispensed from the print nozzle 102, the drive bubble 206 will collapse thereby restoring contact with the sensor 106 to ink. As a result, the voltage will vary over a period of time. The DBD circuit module 104 determines the voltage at the second predetermined time instant. Since during the present stage, the ink is expected to have flowed back into the ink chamber of the print nozzle 102, the second predetermined time instant is referred to as the ink_in time. The ink_in time and the ink_out time are stored, respectively, within the ink_in time repository 118 and ink_out time repository 116.

Continuing with the present example, the voltage across the print nozzle 102 is measured after the delayed fire pulse has been initiated. In one example, the voltage is measured at time instants with respect to the falling edge of the delayed fire pulse. In one example, at the instant when the falling edge of the delayed fire pulse occurs, the ink sensing module 124 measures the voltage across the print nozzle 102. When the falling edge of the firing pulse occurs, the drive bubble 206 may have formed, or may be in the process of being formed. At this stage, the ink within the print nozzle 102 may not be in contact with the sensor 106. As a result, the measured voltage will be correspondingly high. The DBD module 104 subsequently obtains the ink_out time from the ink_out time repository 116. As mentioned previously, the ink_out time specifies the time at which the drive bubble 206 would have formed for a properly functioning print nozzle 102.

Upon obtaining the ink_out time from the ink_out time repository 116, the DBD circuit module 104 obtains the voltage across the print nozzle 102 from the ink sensing module 124. The DBD module 104 then determines and compares the voltage across the print nozzle 102 at the instant prescribed by the ink_out time, with a threshold voltage. Depending on whether the voltage is high, the DBD module 104 may determine whether the print nozzle 102 is functioning in the desired manner. For example, if the voltage across the print nozzle 102 is less than the threshold voltage, there is an indication that the drive bubble 206 either formed late or did not form at all, which in turn would indicate that the print nozzle 102 is blocked. The ink_out time is determined with respect to the instance when the falling edge of the delayed fire pulse occurs. In one example, the time elapsed from the instance of the falling edge of the delayed fire pulse, may be measured through a clocked signal provided by the clock 114. In another example, the DBD module 104 provides an output indicating the determination for the ink_out time as ink_out test result 108.

The drive bubble 206 formed should continue to expand until an ink drop 208 is formed and ejected from the print nozzle 102. When the ink drop 208 is ejected, the drive bubble 206 should collapse and the ink should again come in contact with the sensor 106. As a result, the voltage measured across the print nozzle 102 should also drop. The DBD circuit module 104 determines whether the variation in the voltage occurs, i.e., whether the voltage measured across the print nozzle 102 is lower than the threshold voltage at a second predefined time instant. In one example, the DBD module 104 determines whether the voltage variation, occurring due to the collapsing of the drive bubble 206, occurs by the time instant prescribed by the ink_in time. The ink_in time may be obtained from the ink_in time repository 118.

Based on the voltage determined at the ink_in time, the DBD circuit module 104 determines whether the print nozzle 102 is working in the desired manner. For example, if the voltage across the print nozzle 102 does not change, i.e., remains high, it may be concluded that the drive bubble 206 has persisted within the print nozzle 102 for a longer time period. This typically occurs when an ink drop, say ink drop 208, takes a longer time to form particularly due to a blocked nozzle. It may also be the case that a stray bubble has a perhaps formed within the print nozzle 102.

If however, the DBD circuit module 104 determines that the voltage across the print nozzle 102 is less than the threshold voltage at the ink_in time, it may be concluded that the print nozzle 102 is working in the desired manner. In one example, the DBD module 104 provides an output indicating the determination for the ink_in time as ink_in test result 110. In one example, both the ink_out test result 108 and the ink_in test result 110 are considered for determining whether the print nozzle 102 is functioning in the proper manner. In another example, the voltage across the print nozzle 102 may be determined with respect to a threshold voltage, provided by threshold source 120.

In yet another example, the timing circuitry 112 may be employed for measuring impedances at the ink_out time instant and the ink_in time instant. In such a case, the timing circuitry 112 may measure the time that as elapsed from the occurrence of the delayed fire pulse based on a clocked signal from clock 114. Once the time as prescribed by the ink_out time has been reached, the timing circuitry 112 may activate the DBD module 104 to determine a logical output based on the voltage measured at the ink_out time instant. The logical output may be determined based on the comparison between the voltage measured and a threshold voltage.

The logical output may be registered within the DBD circuit module 104 as the ink_out test result 108. In another example, the DBD circuit module 104 may further include one or more latches which stores ink_out test result 108. Similarly, the timing circuitry 112 may also monitor the time using the clocked signal from clock 114. As the time instant prescribed by the ink_in time occurs, the timing circuitry 112 may further activate the DBD circuit module 104 to determine another logical output and store the same. In an example, another logical output may be stored as the ink_in test result 110.

Table 1 below, shows various issues which could be present within a print nozzle, such as the print nozzle 102*b*, depending on an ink_out test result 108 and an ink_in test result 110.

TABLE 1

| ink_out test | ink_in test | Issue |
|---|---|---|
| 0 | 0 | Weak or no bubble |
| 0 | 1 | Unexpected |

TABLE 1-continued

| ink_out test | ink_in test | Issue |
|---|---|---|
| 1 | 0 | Normal |
| 1 | 1 | Nozzle blockage or ink inlet blockage |

Depending on the issue determined as shown in Table 1, appropriate remedial action may be initiated.

Figure 5:
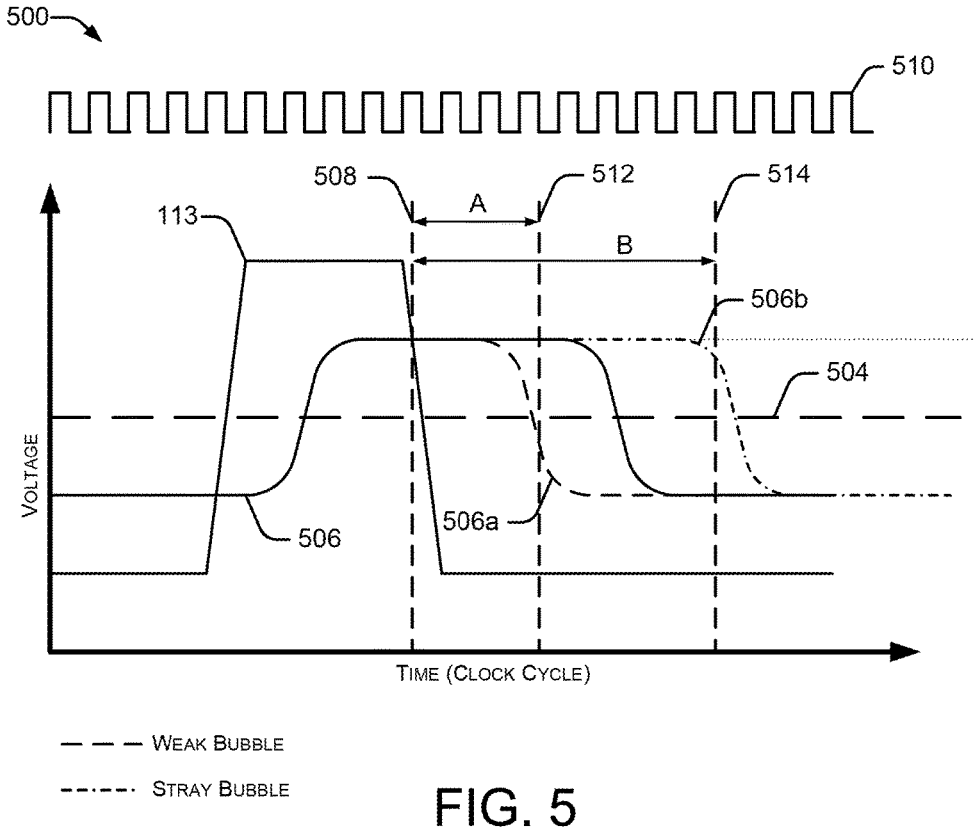
FIG. 5 shows an example graphical representation depicting example variations in voltage measured across a print nozzle.

FIG. 5 provides an example graphical representation 500 depicting example variations in the voltage measured across the print nozzle 102. The graph 500 is only provided for the sake of illustration and should not be construed as a limitation. Other graphs depicting such variations would also be within the scope of the present subject matter. The graph 500 depicts a delayed fire pulse 113 and a threshold voltage 504. The threshold voltage 504 may be provided by a source such as threshold source 120. The variations in the voltage occurring at the print nozzle 102 are indicated by the graph 506. In operation, the printing process is initiated by the delayed fire pulse 113. Prior to the delayed fire pulse 113, the ink is present in the print nozzle 102. Since the ink offers low impedance to a current provided by the sensor 106, the voltage 506 across the print nozzle 102 is also low. As the process initiates a drive bubble, such as drive bubble 206, the voltage 506 increases across the print nozzle 102.

The DBD circuit module 104, on the falling edge of the delayed fire pulse 113, determines and compares the voltage 506 at instants as prescribed by the ink_out time and ink_in time with the threshold voltage 504. In one example, the DBD circuit module 104 starts monitoring the voltage 506 at the instance 508. The DBD circuit module 104 measures the voltage 506 with respect to the threshold voltage 504, at the ink_out time. The time period as prescribed by the instant ink_out time is depicted by instant 512. In one example, the duration "A" over which the ink_out time has elapsed may be measured through the clocked signal 510 provided by the clock 114. The voltage 506 is measured by the ink sensing module 124 and provided to the DBD circuit module 104.

The DBD circuit module 104 compares the voltage 506 with the threshold voltage 504 to determine whether the print nozzle 102 is working in a desired manner. For example, if the voltage 506 does not vary with respect to the threshold voltage 504 and remains high, the DBD circuit module 104 may provide an ink_out test result 108 as positive indicating that the drive bubble 206 is being formed or has formed properly. If however, at the ink_out time, the voltage 506 is below or less than the threshold voltage 504 (as depicted by graph 506*a*), the drive bubble detect module 104 may determine that the drive bubble 206 formed was weak or not properly formed. The ink_out test result 108 may be provided as a binary value, i.e., either as a 0 or 1. For example, an ink_out test result 108 of 0 may be indicative of a formation of a weak drive bubble 206. On the other hand, an ink_out test result 108 as 1, may indicate that the drive bubble 206 was formed properly.

The DBD circuit module 104 further compares the voltage 506 measured by the ink sensing module 124, with the threshold voltage at a second predetermined time instant. In one example, the DBD module 104 compares the voltage 506 at the time instant ink_in time, with the threshold voltage 504. The ink_in time, as illustrated in FIG. 5 by duration "B", is depicted as the instant 514. At the ink_in time, the DBD module 104 determines whether the voltage 506 falls below the threshold voltage 504. As described in detail in the preceding paragraphs, the voltage 506 would increase when the drive bubble 206 collapses and the ink is again brought in contact with the sensor 106. If the decrease in the voltage 506 occurs by the ink_in time, the drive bubble detect module 104 may determine that the drive bubble 206 collapsed at the desired time, and that the print nozzle 102 is working in a proper manner. It may also be the case that the drive bubble detect module 104 determines that the decrease in the voltage 506 occurred after the ink_in time (as depicted by plot 506*b*). Such a scenario would typically arise when the drive bubble 206 did not collapse as planned and persisted for a longer period of time. In such a case, the DBD module 104 may attribute this to a blocked nozzle condition.

The determination of whether the print nozzle 102 is blocked or not, may be provided by the DBD circuit module 104 as the ink_in test result 110. The ink_in test result 110 may in turn be represented through binary values. For example, an ink_in test result 110 of 0 may indicate that the print nozzle 102 is blocked. On the other hand, an ink_in test result 110 of 1, could be used to indicate that the print nozzle 102 is not blocked. In addition, the ink_out test result 108 and the ink_in test result 110 may be collectively used for determining whether the print nozzle 102 is functioning in the desired manner. For example, the drive bubble detect module 104 may provide the ink_out test result 108 and the ink_in test result 110 as a two bit output. The two bit output may be processed on the print head on which the print nozzle 102 is implemented, or may be communicated to the processing unit of the printer (say printer 101) for representing the condition of the print nozzle 102. Depending on the condition of the print nozzle 102, appropriate remedial action, such as servicing or replacing the print head, may be initiated.

The above examples which have been provided determine print nozzle conditions based on determinations as to how the voltage across the print nozzle varies at predefined time instants. The time instants are measured from the falling edge of a delayed fire pulse such as delayed fire pulse 113. However, in other examples, the time instants can also be measured from the leading edge of the delayed fire pulse.

Figure 6:
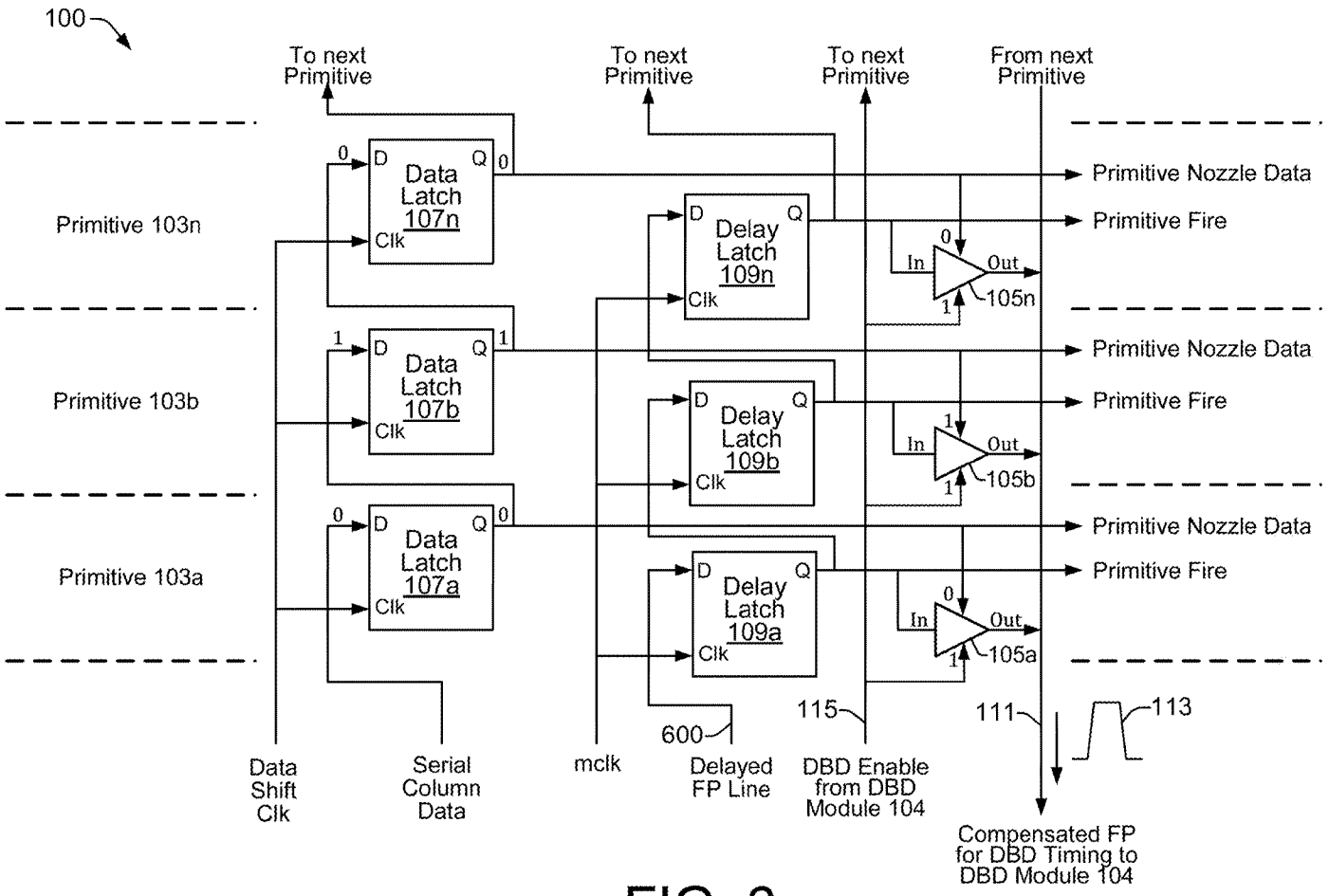
FIG. 6 shows portions of example circuitry in an example system for determining print head nozzle conditions based on drive bubble detect measurements.

FIG. 6 illustrates portions of circuitry of an example system 100 for determining print head nozzle conditions based on drive bubble detect (DBD) measurements. The circuitry uses a delayed fire pulse received at a nozzle under test to ensure that the timing of the DBD measurements is based on the actual nozzle firing time. The circuitry of system 100 is implemented within a print head of a printer. Referring to FIGS. 1 and 6, as noted above, the example system 100 includes a plurality of print nozzles 102 (illustrated in part as nozzles 102*a*-102*n*) arranged in columns (not shown) and grouped together in primitives 103 (illustrated as primitives 103*a*-103*n*). Each primitive 103 includes a tri-state buffer device 105, a data latch 107, and a delay latch 109. A compensated fire pulse bus 111 runs through each primitive 103 along the length of a column to carry a delayed fire pulse 113 to the DBD module 104 from a primitive 103 that contains a print nozzle under-test, for example, such as primitive 103*b* that contains a nozzle under test 102*b* (i.e., a nozzle 102*b* being measured). A DBD enable bus 115 also runs through each primitive 103 along the length of a column to carry an enable signal to a tri-state buffer 105 associated with the primitive 103*b* that contains the nozzle under test 102*b*.

Referring still to FIGS. 1 and 6, in an example print mode of system 100, the data latch 107 is loaded with a "1" for each primitive having a nozzle to be fired (i.e., each nozzle to eject an ink drop). An initial fire pulse is then sent down the series of primitives, and a nozzle or nozzles within each primitive whose data latch 107 has a loaded "1", will fire when the fire pulse arrives at that primitive. However, the fire pulse arriving at each primitive is delayed from the initial fire pulse by varying amounts, depending on how far down the series of primitives the particular primitive is located. Accordingly, an initial fire pulse cannot be used as a reference to inform the DBD circuit module 104 when a particular nozzle in a primitive is firing. Thus, the initial fire pulse cannot be used by the DBD circuit module 104 to initiate a properly timed drive bubble detect measurement of a nozzle under test, because the nozzle under test will not fire (i.e., will not generate a drive bubble) until the fire pulse arrives locally at the nozzle primitive in its delayed fire pulse state. Therefore, in a test mode of the system 100, circuitry is designed to compensate for the delay in the initial fire pulse by providing the delayed fire pulse 113 back to the DBD module 104 as a true indication of the time when a nozzle under test (e.g., nozzle 102*b*) actually fires. The DBD module 104 uses the delayed fire pulse 113 to initiate DBD measurements at appropriate times during the formation and collapse of a drive bubble in the nozzle under test 102*b*, such as a first predetermined time instant following the trailing edge of the delayed fire pulse 113 when a drive bubble is expected, and a second predetermined time instant following the trailing edge of the delayed fire pulse 113 when the drive bubble is expected to have collapsed.

Referring still to FIGS. 1 and 6, in an example test mode of system 100, DBD measurements can be made on an example nozzle 102 within a primitive 103. The test mode can be initiated by the DBD circuit module 104 which places an enable signal "1" on the DBD enable bus 115, which carries the enable signal to all the tri-state buffers 105. DBD measurements can then be made on a specified nozzle under test, such as nozzle 102*b*, by first loading a "1" into the data latch 107*b* of the nozzle's primitive 103*b*. Loading the data latch 107 of a primitive with a "1" effectively selects a nozzle within that primitive to be the nozzle under test (i.e., the nozzle whose drive bubble is to be measured), such as loading the data latch 107*b* of primitive 103*b* with a "1" to select nozzle 102*b* as the nozzle under test. A "0" will be loaded into the data latches 107 of all the other primitives 103. The resulting "1" at the output "Q" of data latch 107*b* of primitive 103*b*, causes the tri-state device 105*b* in primitive 103*b* to drive whatever is at its input (In) onto its output (Out). Each tri-state device 105 output is coupled to the compensated fire pulse bus for DBD timing wire 111 that runs through each primitive and connects to the DBD module 104.

Once the data latch 107 (e.g., data latch 107*b*) of the desired primitive (e.g., primitive 103*b*) is loaded with a "1", an initial fire pulse signal is sent out onto the fire pulse line 600 of the delay latches 109. The fire pulse line 600 is labeled as a "delayed FP line" because when the fire pulse signal arrives at each delay latch 109, it has been delayed by the previous delay latch of the previous primitive. Thus, the initial fire pulse signal is clocked through, and propagates down, each primitive 103 as a delayed fire pulse signal until it eventually arrives at the delay latch 109*b* of primitive 103*b*, whose data latch 107*b* is loaded with a "1". Note that as the delayed fire pulse signal propagates through each primitive, none of the nozzles fire whose associated data latches 107 have been loaded with a "0". Furthermore, tri-state devices 105 associated with data latches 107 loaded with a "0" have high impedance outputs (Out) and do not drive their inputs (In) onto their outputs (Out). Thus, when the delayed fire pulse signal hits the delay latch 109*a* of primitive 103*a*, which precedes primitive 103*b* in the series of primitives, the nozzle 103*a* does not fire and the tri-state device 105*a* in primitive 103*a* does not put anything onto the compensated fire pulse bus 111. However, when the delayed fire pulse hits the delay latch 109*b* of primitive 103*b*, whose data latch 107*b* is loaded with a "1", the nozzle 102*b* fires (i.e., generates a drive bubble) and the delayed fire pulse signal at the "Q" output of the delay latch 109*b* of primitive 103*b* is driven by the tri-state device 105*b* onto the compensated fire pulse bus 111. This ensures that DBD circuit module 104 knows the precise time when the nozzle under test 102*b* has fired, enabling the DBD module 104 to determine time instants following the firing time when DBD measurements can be made on nozzle 102*b*. For example, DBD circuit module 104 can determine time instants for making DBD measurements such as a first predetermined time instant that follows the trailing edge of the delayed fire pulse 113 when a drive bubble is expected, and a second predetermined time instant that follows the trailing edge of the delayed fire pulse 113 when a drive bubble is expected to have collapsed.

Figure 7:
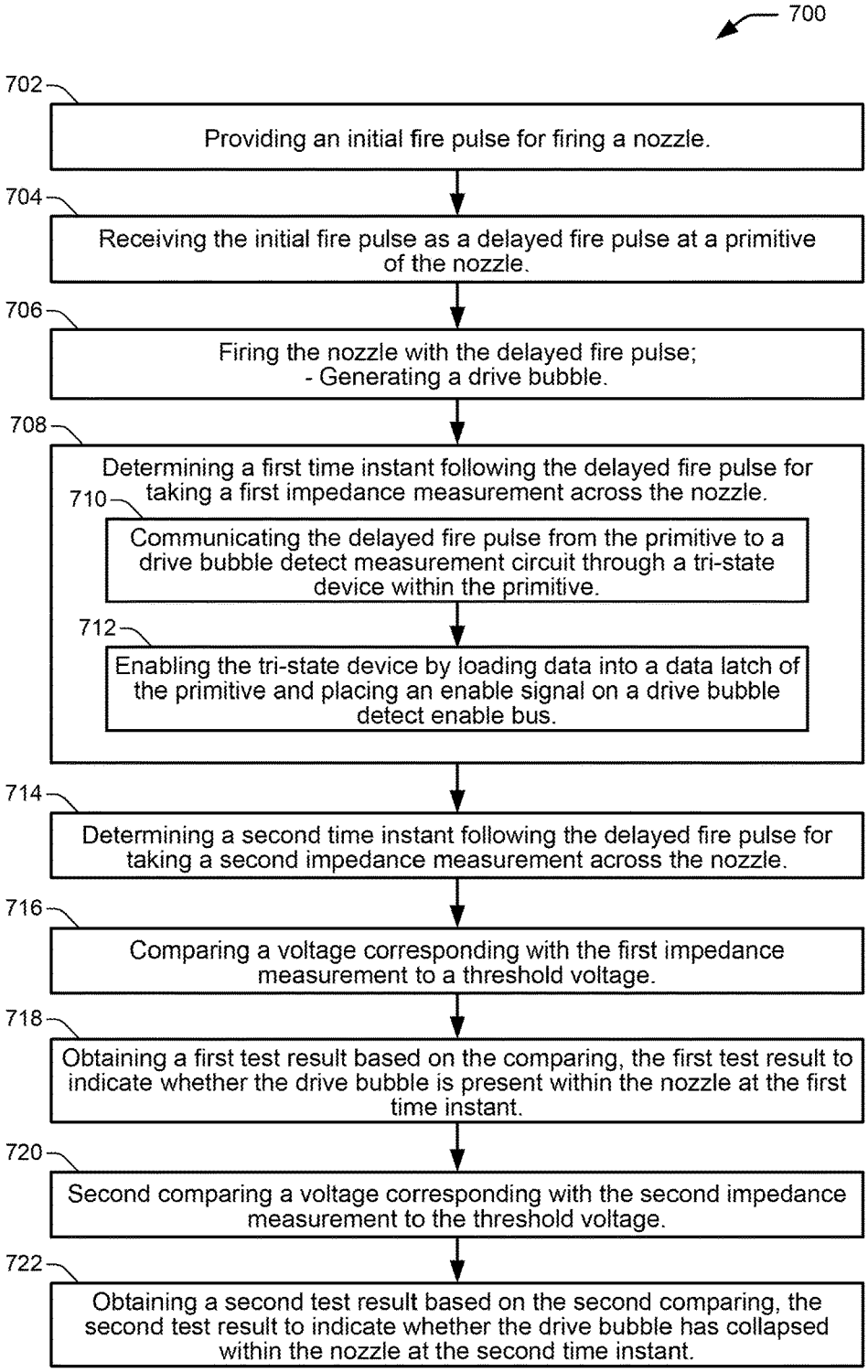
FIG. 7 shows a flow diagram of an example method for determining an issue in an inkjet nozzle.

FIG. 7 shows a flow diagram that illustrates an example method 700 for determining an issue in an inkjet nozzle. The method 700 is associated with examples discussed herein with regard to FIGS. 1-6, and details of the operations shown in method 700 can be found in the related discussion of such examples. Method 700 may include more than one implementation, and different implementations of method 700 may not employ every operation presented in the flow diagram. Therefore, while the operations of method 700 are presented in a particular order within the flow diagram, the order of their presentation is not intended to be a limitation as to the order in which the operations may actually be implemented, or as to whether all of the operations may be implemented. For example, one implementation of method 700 might be achieved through the performance of a number of initial operations, without performing one or more subsequent operations, while another implementation of method 700 might be achieved through the performance of all of the operations.

Referring to the flow diagram of FIG. 7, an example method 700 begins at block 702 where a first operation includes providing an initial fire pulse for firing a nozzle. A fire pulse can be generated, for example, in a fire pulse generator on a print head. At block 704 of method 700, the initial fire pulse is received at a primitive that contains the nozzle. The initial fire pulse is received as a delayed fire pulse that has been delayed, for example, by delay elements within subsequent primitives. As shown at block 706, the method includes firing the nozzle with the delayed fire pulse. Firing the nozzle generally includes generating a drive bubble within the nozzle. The method 700 continues at block 708 with determining a first time instant following the delayed fire pulse for taking a first impedance measurement associated with the nozzle. Determining a first time instant, as shown at block 710, can include communicating the delayed fire pulse signal from the primitive to a drive bubble detect measurement circuit. The fire pulse signal is communicated through a tri-state device within the primitive. This includes enabling the tri-state device by loading data into a data latch of the primitive and placing an enable signal on a drive bubble detect enable bus, as shown at block 712.

In some examples, the method 700 also includes determining a second time instant following the delayed fire pulse for taking a second impedance measurement associated with the nozzle, as shown at block 714. As shown at blocks 716 and 718, respectively, the method continues with comparing a voltage corresponding with the first impedance measurement to a threshold voltage, and obtaining a first test result based on the comparing. The first test result is to indicate whether the drive bubble is present within the nozzle at the first time instant. Further, at blocks 720 and 722, the method continues respectively with a second comparing of a voltage corresponding with the second impedance measurement to the threshold voltage, and obtaining a second test result based on the second comparing. The second test result is to indicate whether the drive bubble has collapsed within the nozzle at the second time instant.

What is claimed is:

1. A print head comprising:

a nozzle to be activated by a delayed fire pulse that is delayed from an initial fire pulse;

a sensor to measure an impedance of the nozzle; and a detector to determine a first time instant following the delayed fire pulse for registering a first impedance measurement by the sensor.

2. The print head of claim 1, wherein the detector is to determine a second time instant following the delayed fire pulse for registering a second impedance measurement by the sensor.

3. The print head of claim 1, wherein the detector comprises a latch, and the detector is to register the first impedance measurement by storing, in the latch, a result responsive to the first impedance measurement.

4. The print head of claim 1, wherein the nozzle upon activation in response to the delayed fire pulse generates a drive bubble, and the detector is to:

compare a voltage corresponding to the first impedance measurement with a threshold voltage; and obtain a first test result based on the comparing, the first test result to indicate whether the drive bubble is present within the nozzle at the first time instant.

5. The print head of claim 4, wherein the detector is to:

determine a second time instant following the delayed fire pulse for registering a second impedance measurement by the sensor;

further compare a voltage corresponding to the second impedance measurement with the threshold voltage; and obtain a second test result based on the further comparing, the second test result to indicate whether the drive bubble has collapsed within the nozzle by the second time instant.

6. The print head of claim 1, further comprising:

a primitive comprising the nozzle and a tri-state device, wherein the determining of the first time instant following the delayed fire pulse comprises communicating the delayed fire pulse from the primitive to the detector through the tri-state device.

7. The print head of claim 6, wherein the primitive further comprises a data latch, and wherein the communicating of the delayed fire pulse from the primitive to the detector through the tri-state device comprises enabling the tri-state device by loading data into the data latch of the primitive and placing an enable signal on a bus.

8. The print head of claim 1, wherein the delayed fire pulse is a first delayed fire pulse, the print head further comprising:

a first primitive comprising the nozzle, the sensor, and a first buffer when enabled to drive the first delayed fire pulse to the detector; and a second primitive comprising a second nozzle, a second sensor, and a second buffer when enabled to drive a second delayed fire pulse to the detector, the second delayed fire pulse delayed from the initial fire pulse by an amount different from the first delayed fire pulse, wherein the detector is to determine a time instant following the second delayed fire pulse for registering an impedance measurement by the second sensor.

9. A fluid ejection die comprising:

a drive bubble detect (DBD) module; and a primitive including a nozzle and a tri-state device, the primitive to receive a delayed fire pulse to fire the nozzle, and the tri-state device to communicate the delayed fire pulse to the DBD module, the DBD module to determine, based on the delayed fire pulse, a first time instant following the firing of the nozzle at which to perform a first DBD impedance measurement associated with the nozzle.

10. The fluid ejection die of claim 9, further comprising:

a plurality of primitives arranged along a nozzle column; and a first bus running along a length of the column through each primitive and coupled to an output of a tri-state device in each primitive.

11. The fluid ejection die of claim 10, further comprising a second bus running along the length of the column through each primitive to carry an enable signal to the tri-state devices in the plurality of primitives.

12. The fluid ejection die of claim 10, wherein the first bus couples the output of each tri-state device with the DBD module.

13. The fluid ejection die of claim 9, further comprising:

a data latch of the primitive to receive data to enable the tri-state device; and a delay latch of the primitive to receive the delayed fire pulse and to transfer the delayed fire pulse to an input of the tri-state buffer.

14. The fluid ejection die of claim 9, the DBD module to further determine a second time instant following the firing of the nozzle at which to perform a second DBD impedance measurement associated with the nozzle, the fluid ejection die further comprising:

an ink_out time repository to store an ink_out time result determined from the first DBD measurement; and an ink_in time repository to store an ink_in time result determined from the second DBD measurement.

15. The fluid ejection die of claim 14, further comprising a threshold source to provide a threshold voltage to compare with a voltage associated with the nozzle to determine the ink _in time and the ink _out time.

16. A fluid ejection device comprising:

a nozzle to fire in response to receiving a delayed fire pulse;

a sensor within the nozzle;

a detector to determine a condition of the nozzle based on a measurement by the sensor, the detector to register the measurement by the sensor at a time instant following the delayed fire pulse; and a tri-state device to communicate the delayed fire pulse to the detector.

17. The fluid ejection device of claim 16, wherein the time instant is selected from the group consisting of a first time instant at which a drive bubble is expected to be present within the nozzle, and a second time instant at which the drive bubble is expected to have collapsed within the nozzle.

18. The fluid ejection device of claim 16, wherein the detector comprises a latch, and the detector is to register the measurement by storing, in the latch, a result responsive to the measurement.

19. The fluid ejection device of claim 18, wherein the detector is to produce the result by comparing the measurement to a threshold.

20. The fluid ejection device of claim 16, further comprising a bus over which the tri-state device outputs the delayed fire pulse, the fluid ejection device further comprising another tri-state device to output another delayed fire pulse for another nozzle over the bus.

* * * * *